US005302048A

United States Patent [19]

Paulos et al.

[11] Patent Number: 5,302,048

[45] Date of Patent: Apr. 12, 1994

[54] RESILIENT PAVEMENT MARKER

[75] Inventors: Dean H. Paulos, Columbus, Ohio; Kenneth L. Todd, Roseville, Mich.

[73] Assignee: Olympic Machines, Inc., Columbus, Ohio

[21] Appl. No.: 837,784

[22] Filed: Feb. 18, 1992

[51] Int. Cl.[5] ..... E01F 9/00

[52] U.S. Cl. ..... 404/11; 404/16

[58] Field of Search ..... 404/9, 10, 11, 16

[56] References Cited

U.S. PATENT DOCUMENTS

| | | | |
|---|---|---|---|
| 1,496,811 | 6/1924 | Lange . | |
| 1,797,498 | 3/1931 | Finley | 404/11 |
| 1,825,667 | 10/1931 | Johnson | 404/11 |
| 1,870,994 | 8/1932 | George . | |
| 1,905,612 | 4/1933 | Wagner . | |
| 2,005,170 | 6/1935 | Segelhorst . | |
| 2,073,968 | 3/1937 | Krebs | 404/11 |
| 2,127,700 | 8/1938 | Rosener | 404/11 |
| 2,146,359 | 2/1939 | Shaw . | |
| 2,157,059 | 5/1939 | Rosener | 404/11 |
| 2,192,878 | 3/1940 | Beebe | 404/10 |
| 2,224,937 | 12/1940 | Stedman . | |
| 2,229,179 | 1/1941 | Langdon . | |
| 2,260,498 | 10/1941 | Wise . | |
| 2,627,784 | 2/1953 | Pellar . | |
| 2,703,038 | 3/1955 | Shaw . | |
| 2,941,447 | 6/1960 | Abbott, Sr. | 404/11 |
| 2,981,149 | 4/1961 | Stolarczyk et al. | 116/63 |
| 3,216,335 | 11/1965 | Stolarczyk et al. | 404/11 |
| 3,292,506 | 12/1966 | Kone | 404/11 |
| 3,377,930 | 4/1968 | Kone | 404/11 |
| 3,502,008 | 3/1970 | Macrae | 404/10 |
| 3,703,855 | 11/1972 | Converso | 404/11 |
| 3,717,076 | 2/1973 | Shields et al. | 404/11 |
| 3,850,536 | 11/1974 | Kone | 404/11 |
| 3,920,348 | 11/1975 | Paulos | 404/72 |
| 4,049,358 | 9/1977 | King et al. | 404/11 |
| 4,130,370 | 12/1978 | Kone | 404/11 |
| 4,155,666 | 5/1979 | Flanagan | 404/16 |
| 4,195,945 | 4/1980 | Heenan | 404/16 |
| 4,297,051 | 10/1981 | Robinson | 404/11 |
| 4,413,923 | 11/1983 | Wright | 404/11 |
| 4,504,169 | 3/1985 | Jones | 404/11 |
| 4,595,312 | 6/1986 | Corless | 404/11 |
| 4,597,691 | 7/1986 | Clarke | 404/11 |
| 4,685,824 | 8/1987 | Eigenmann | 404/9 |
| 4,737,049 | 4/1988 | Callhan | 404/11 |
| 4,955,982 | 9/1990 | Paulos | 404/11 |

FOREIGN PATENT DOCUMENTS

| | | | |
|---|---|---|---|
| 502023 | 11/1954 | Italy | 404/11 |
| 8807606 | 10/1988 | PCT Int'l Appl. | 404/11 |
| 383527 | 11/1932 | United Kingdom . | |
| 436290 | 10/1935 | United Kingdom . | |
| 738993 | 10/1955 | United Kingdom . | |
| 965583 | 7/1964 | United Kingdom . | |

*Primary Examiner*—William P. Neuder

*Attorney, Agent, or Firm*—Harness, Dickey & Pierce

[57] ABSTRACT

A resilient pavement marker for delineating lanes and shoulders of roadways which is not susceptible to the forces associated with plowing of the road or damage from environmental conditions. The marker incorporates an assembled unit which may be readily installed within the roadway including a base housing, a depressible piston which carries a detachable lens assembly, and a compressible biasing assembly to facilitate depression of the piston and return to its original position. The piston is retained within the housing by a cap cooperating with the base. The cap includes an opening which has a lobed or scalloped configuration adapted to cooperate with the scalloped configuration of the piston thereby preventing rotation of the piston within the housing. The lens assembly is removable from the piston to facilitate simple replacement of the reflective lenses without removal or disassembly of the marker. The compression assembly fills substantially the entire interior of the housing and includes closed-cell members to eliminate absorption of moisture and damage from freezing.

21 Claims, 4 Drawing Sheets

RESILIENT PAVEMENT MARKER

BACKGROUND OF THE INVENTION

I. Field of the Invention

This invention relates to depressible, reflective pavement markers for delineating roadways and, in particular, to a resilient pavement marker which is resistant to rotation from external forces yet ensures depression and return of the reflector assembly above the road surface.

II. Description of the Prior Art

The benefits of roadway lane markers to delineate traffic paths for drivers are unquestioned. Pavement markers are more desirable than the usual painted dividing lines because such reflective markers are more visible to a driver over a greater distance and will function better in many instances where painted traffic lines are seen by a driver only with difficulty such as on wet roadways, snow covered roadways or in fog. The prior known markers typically are available in two forms—the surface mount marker secured directly to the roadway surface or an imbedded marker positioned within a preformed hole in the roadway. Surface mount markers are more widely utilized in warmer climates where the markers would not be subject to the shearing effects of a snow plow. The structural integrity of imbedded markers makes them more suitable for roadways subject to various weather conditions.

In order to withstand the forces of oncoming snowplows and vehicle tires, a variety of retractable road markers have been developed. The retractable marker, although it protrudes above the road surface, may be depressed by the blow of a snowplow blade or vehicle tire. Typically, a beveled upper surface formed on the reflector protrusion provides an inclined plane across which the blade or tire rides deflecting the protruding portion of the marker downwardly into its housing. Such depressible markers have incorporated spring assemblies for biasing the reflector, flexible diaphragms which carry the reflector or foam rubber cells facilitating depression of the reflector. However, the effects of dirt and grime, freezing and thawing, snow, rainwater and the forces associated with the road traffic all detrimentally effect the prior known depressible reflectors. Over time reflectors which depend upon exposed rubber components deteriorate to failure. Still other reflectors cannot withstand the torquing effect of the snow plow blades engaging the reflector.

A significant disadvantage of prior known pavement markers is encountered when the reflector becomes damaged requiring repair. The roadway markers used in the past require removal of the entire assembly from the roadway or, at a minimum, disassembly of the housing in order to effect a repair as simple as replacing a shattered reflective lens.

SUMMARY OF THE PRESENT INVENTION

The present invention overcomes the disadvantages of the prior known pavement markers by providing a resilient marker which can withstand the forces of traffic and snowplows yet provides simple repair in the event of damage to the marker.

The resilient pavement marker of the present invention includes a housing which may be securely imbedded within the pavement, a piston which carries a replaceable reflector lens assembly, and resilient biasing means urging the piston upwardly to raise the lens assembly above the road surface. In a preferred embodiment, the biasing means comprises one or more closed-cell compressible foam members and a resilient rubber center spool for quick rebound and maximum durability. The housing includes a retainer which cooperates with a base to enclose the piston and biasing means. The retainer has a top opening through which the piston may extend to raise the reflector assembly. The piston and the retainer opening are provided with rounded spline or scalloped mating configurations to prevent rotation of the piston, and therefore the reflector lenses, within the housing. The reflector lens is detachable from the piston without disassembly of the marker facilitating repair/replacement of the reflective lenses.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
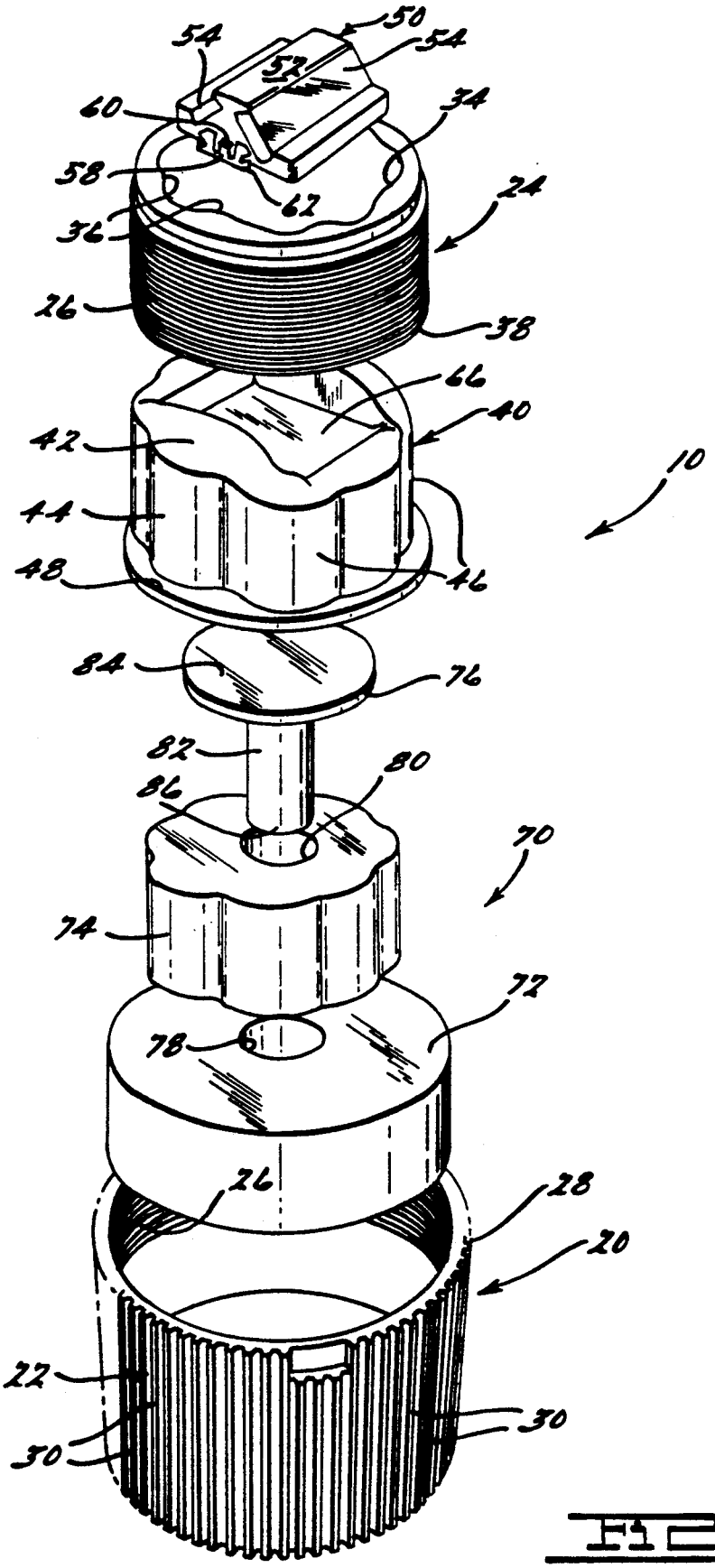
FIG. 1 is an exploded view of a resilient pavement marker embodying the present invention.
Figure 2:
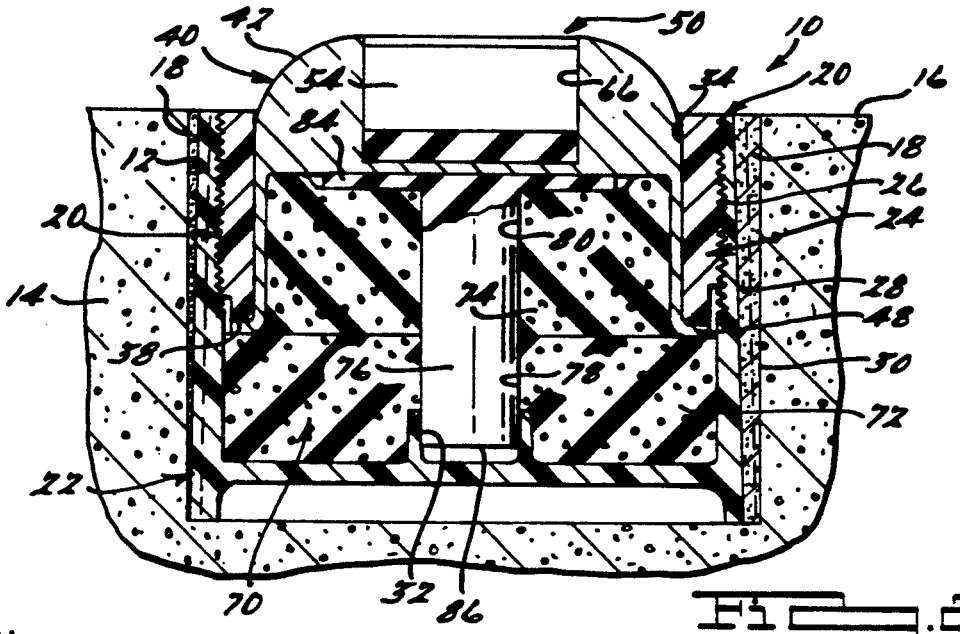
FIG. 2 is a cross-sectional view of the marker imbedded within pavement.
Figure 3:
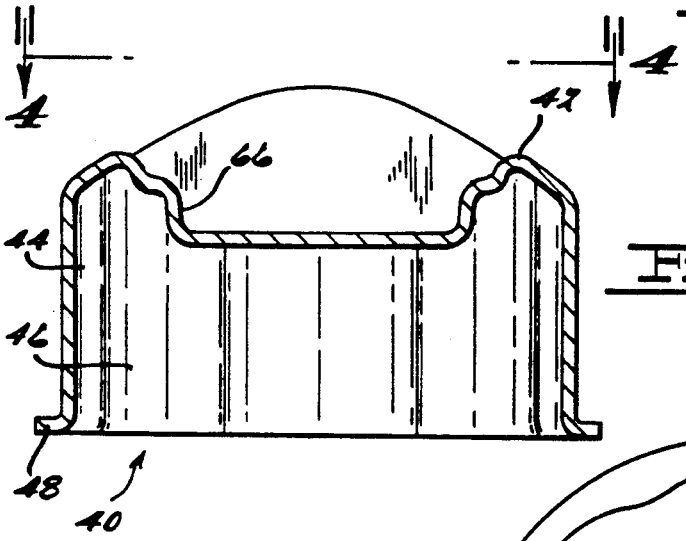
FIG. 3 is a cross-sectional perspective of the piston.
Figure 4:
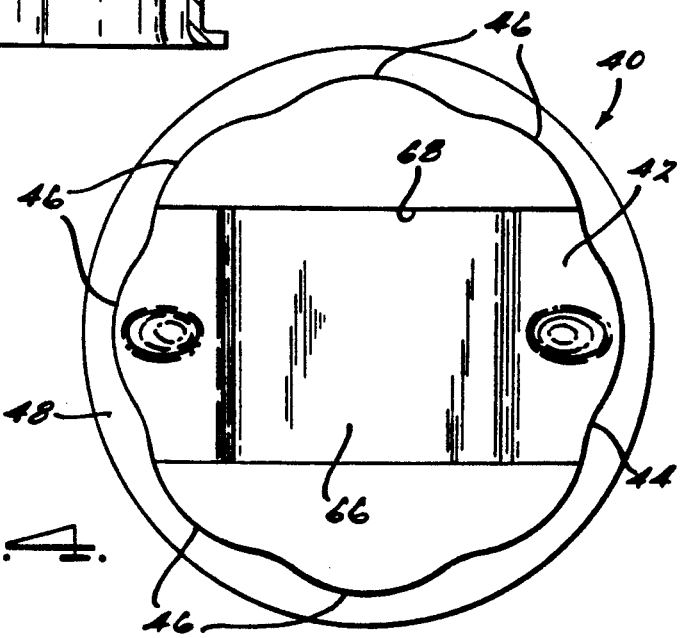
FIG. 4 is a top end view of the piston.
Figure 5:
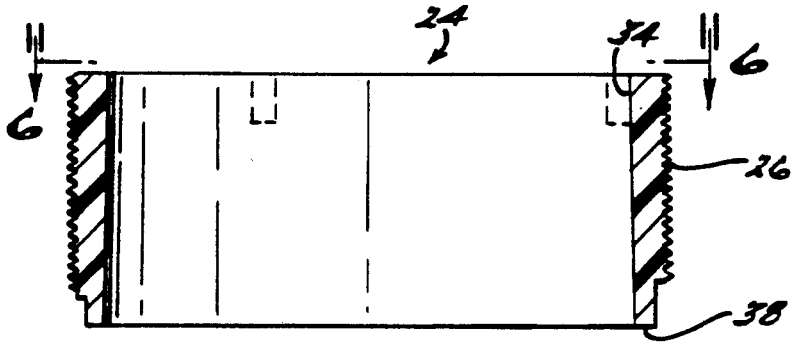
FIG. 5 is a cross-sectional perspective of the retainer.
Figure 6:
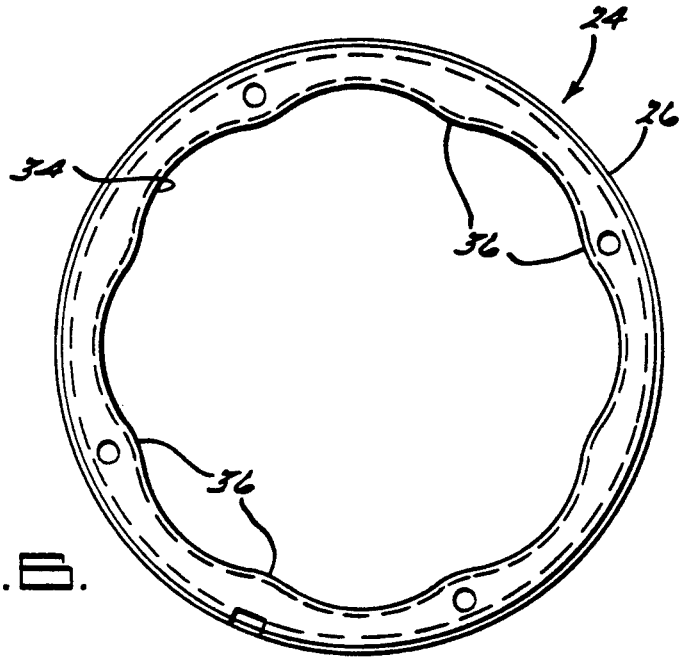
FIG. 6 is a top end view of the retainer.

Referring first to FIGS. 1 and 2, there is shown a reflective pavement marker 10 embodying the present invention and adapted to be fixedly mounted within a hole 12 preformed within pavement 14 forming a road surface 16. The marker 10 is intended to delineate traffic lanes of the road surface 16 to assist drivers in a variety of weather conditions. The marker 10 is secured within the hole 12 using additional cement, asphalt, epoxy or similar materials 18 around the marker 10 as will be subsequently described. The pavement marker 10 broadly comprises a housing 20, a piston 40 reciprocally received within the housing 20, a lens assembly 50 mounted to the piston 40, and resiliently compressible biasing means 70 permitting depression of the piston 40 within the housing 20 in response to surface traffic while ensuring return of the piston 40 to its normal position. The resilient pavement marker 10 of the present invention thus is capable of withstanding the impact of vehicle tires and snowplow blades by retracting below the road surface yet provides effective reflecting to delineate traffic lanes.

Figure 7:
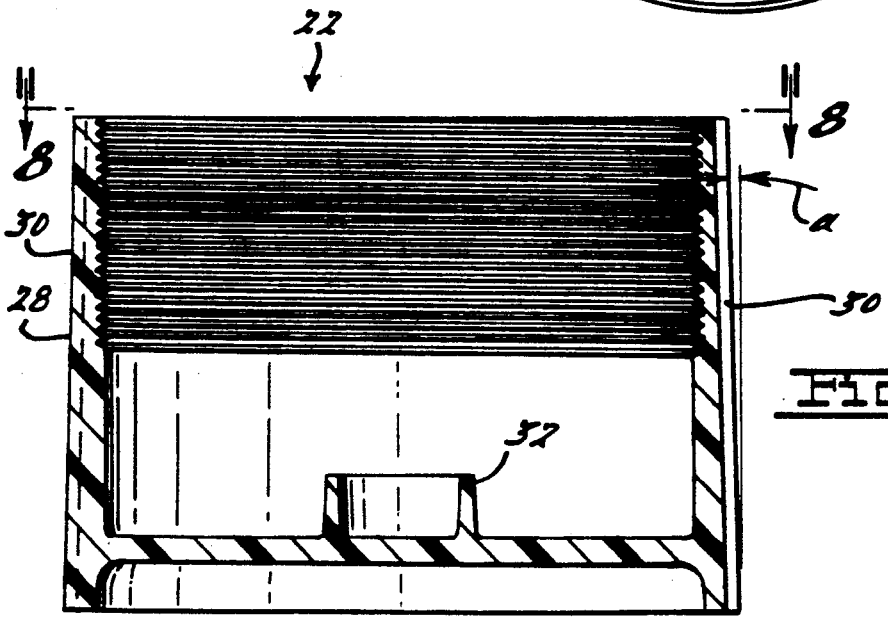
FIG. 7 is a cross-sectional perspective of the housing base.
Figure 8:
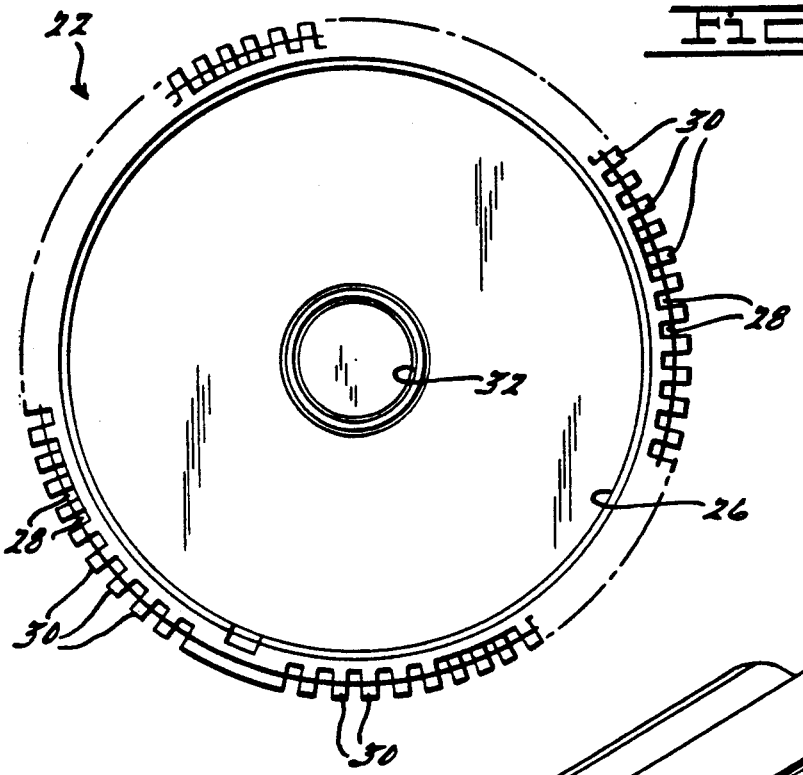
FIG. 8 is a top end view of the base.
Figure 9:
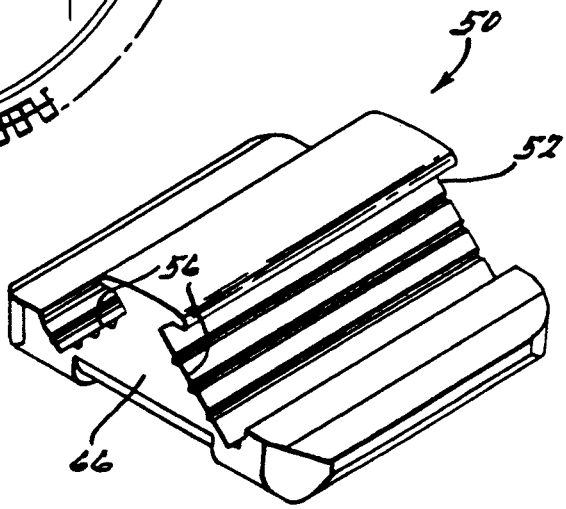
FIG. 9 is a perspective view of the lens assembly.
Figure 10:
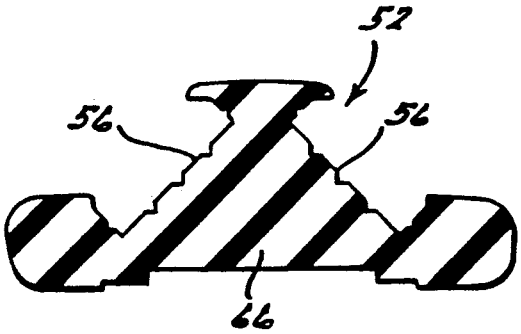
FIG. 10 is a cross-sectional view of the lens holder.
Figure 11:
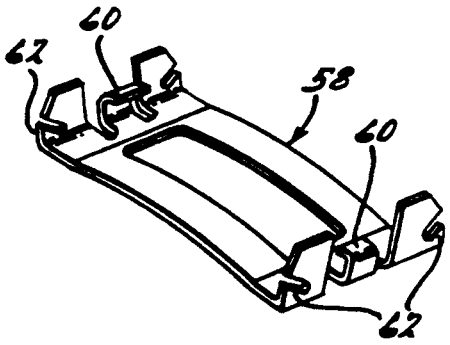
FIG. 11 is a perspective view of the retainer clip of the lens assembly.

Referring now to FIGS. 1 through 8, the housing member includes a base member 22 and a retainer 24 received within the base 22. The base 22 and retainer 24 include cooperating threads 26 such that the base 22 may threadably receive the retainer 24. The retainer 24 is prevented from rotating within the base 22 by at least one shear pin 25 inserted between the base 22 and the retainer 24. The shear pin 25 is inserted once the retainer 24 is threaded into the base 22. As a result, the base 22 may be secured within the pavement opening 12 prior to assembly of the marker 10. As is best shown in FIGS. 2 and 7, the base 22 has a flared outer surface 28 formed at an angle "a" for improved retention within the opening 12. Additionally, vertical ribs 30 on the outer surface 28 of the base 22 provide a mechanical lock with the material 18 used to secure the marker 10 thereby creating additional bonding area to prevent rotation within the opening 12. Formed in the bottom of the base 22 is a centering seat 32 which maintains proper alignment of the compressible biasing means 70, particularly rebound spool 76, as will be subsequently described. The retainer 24 is matingly received within the base 22 thereby retaining the components of the marker 10 within the housing 20. The retainer 24 is in the form of a sleeve with an upper aperture 34 through which the piston 40 extends and a lower end 38. In a preferred embodiment of the present invention, the upper aperture 34 has a non-circular or lobed configuration to maintain alignment of the piston 40 within the retainer 24. The aperture 34 includes a plurality of equally spaced lobes 36 in order to distribute any rotational torque over the entire surface configuration.

The piston 40 is reciprocally received within the retainer 24 such that an upper end 42 of the piston 40 extends above the retainer 24 and therefore the pavement surface 16. The piston 40 is provided with a non-circular or lobed outer configuration 44 designed to mate with the upper aperture 34 of the retainer 24. The peripheral surface 44 of the piston 40 includes a plurality of lobes 46 corresponding to the lobes 36 of the retainer 24 thereby allowing reciprocal movement of the piston 40 within the retainer 24 yet preventing rotation of the piston 40 within the housing 20. As has been previously described, the multi-lobed configuration of the piston 40 mating with the retainer 24 distributes any rotational torque directed against the piston 40 along its entire outer periphery 44 eliminating binding or shearing of tabs as in prior known pavement markers. A flange 48 formed at the bottom end of the piston 40 engages the bottom 38 of the retainer 24 to prevent the piston from leaving the housing 20.

The lens assembly 50 is carried by the piston 40 in order to provide reflective delineation under normal operating conditions. Referring to FIGS. 1 and 9–11, the lens assembly 50 includes a lens holder 52 which retains at least one reflective lens 54. The lens holder 52 has a pair of sloped retention surfaces 56 to maintain the lenses 54 at the preferred angle. The surfaces 56 are preferably recessed within the holder 52 to protect the reflective lenses 54 against direct impact. Unlike the prior known pavement markers which position the lenses at shallow angles to avoid damage, the lenses 54 of the present invention are preferably maintained at a 45° angle for optimum reflective properties. However, the lens angle may be varied according to road specifications simply through the replacement of the lens assembly 50. The lens assembly includes a retention clip 58 which secures to the bottom of the lens holder 52. The clip 58 is provided with center tabs 60 for grasping the holder 52 and outer spring tabs 62 for removable mounting the lens assembly 50 within the piston 40. The center tabs 60 are disposed inwardly to engage the ends 64 of the lens holder 52. The piston 40 includes an upper cavity 66 within which the lens assembly 50 is removably mounted. The outer spring tabs 62 engage the side walls 68 of the cavity 66 to retain the lens assembly 50 within the piston 40. The clip 58 allows removal and replacement of the lens assembly 50 as necessary. As a result, damaged lenses may be replaced from above the pavement surface 16 without dismantling the marker 10. However, the description of the spring clip 58 is provided as an example of suitable means for retaining the lens assembly 50 and alternative forms of the clip 58 may also be suitable.

The resiliently compressible biasing means 70 allows depression of the piston 40 into the housing 20 in response to external forces such as vehicle tires or snowplow blades yet returns the piston 40 and the lens assembly 50 to their normal reflective position to provide delineation of traffic lanes. In a preferred embodiment, the biasing means 70 comprises a lower compression member 72, an upper compression member 74 and a center rebound spool 76. The spool 76 extends through axial throughbores 78 and 80 formed in the lower compression member 72 and upper compression member 74, respectively. The lower compression member 72 fills substantially all the space within the housing 20 below the retainer 24 while the upper compression member 74 fills substantially all the space within the piston 40 thereby minimizing any empty space within which moisture ice and dirt may accumulate. The compression members 72 and 74 are preferably made of a compressible closed-cell foam which is impervious to moisture. The center rebound spool 76 is preferably made of polynorbornene rubber for improved resiliency in order to return the piston 40 to its normal position as efficiently as possible even after repeated depression. Unlike the simple foam pads used in prior markers, the combination foam and rubber of the biasing means 70 ensures full recovery of the piston 40. The spool 76 includes a center post 82 and at least one flange 84 integrally formed with post 82. The lower end 86 of the post 82 is received within the seat 32 formed in the bottom of the base 22 to maintain proper positioning of the biasing means 70 by preventing wandering within the housing 20. The flanged upper end 84 directly engages the underside of the piston 40 to directly bias the piston 40 upwardly against the retainer 24.

The improved reliability and effectiveness of the pavement marker 10 of the present invention provides substantial cost savings in maintaining reflective traffic lanes while also ensuring continued delineation. Once mounted within the pavement 14, the reflective lenses 54 are maintained above the pavement surface 16 by the piston 40 biased upwardly by the compression members 72, 74 and the spool 76. As a vehicle tire, or of greater concern, a snowplow blade passes over the marker 10 the protruding surface 42 of piston 40 will be engaged driving the piston 40 downwardly into the housing 20 against the biasing means 70. The domed upper surface 42 of the piston 40 tends to deflect the force driving the piston 40 downwardly without damage to the marker 10. Nevertheless, as the force is removed the compression members 72, 74 and, in particular, the center rebound post 76 will return the piston to its normal position. Thus, a resilient pavement marker 10 may be imbedded within pavement to reliably delineate traffic lanes.

The foregoing detailed description has been given for clearness of understanding only and no unnecessary limitations should be understood therefrom as some modifications will be obvious to those skilled in the art without departing from the scope and spirit of the appended claims.

What is claimed is:

1. A reflective pavement marker comprising:

a housing adapted to be fixedly mounted within an opening formed within a pavement such that an upper end of said housing is positioned at or below the pavement surface;

a piston reciprocally movable within said housing, said piston including an upper end normally protruding above said housing and the pavement surface, said piston being depressible downwardly in said housing to move said upper end into said housing;

cooperating means formed on said piston and said housing to prevent rotation of said piston within said housing;

a reflector assembly mounted to said upper end of said piston; and resiliently compressible means biasing said piston upwardly to raise said upper end of said piston above said housing and the pavement surface, said biasing means filling substantially all the space within said housing and being resiliently compressible upon depression of said piston into said housing as a result of surface traffic.

2. The pavement marker as defined in claim 1 wherein said reflector assembly is removably mounted to said upper end of said piston to facilitate repair and replacement.

3. The pavement marker as defined in claim 2 wherein said reflector assembly includes a lens holder and a retaining clip, said lens holder receiving at least one reflective lens, said retaining clip receiving said lens holder and detachably mounting said reflector assembly to said piston.

4. The pavement marker as defined in claim 1 wherein said housing includes a base and a retainer threadably attached to said base, said retainer having an upper aperture with a non-circular configuration, said piston matingly received within said retainer aperture and having a non-circular peripheral configuration to prevent rotation of said piston within said retainer and said housing.

5. The pavement marker as defined in claim 4 wherein said aperture of said retainer and said periphery of said piston have mating continuous lobe configurations to prevent rotation of said piston, said piston being reciprocally movable within said aperture of said retainer.

6. The pavement marker as defined in claim 1 wherein said biasing means comprises at least one compression member and a central spool to return said piston to its normal position.

7. The pavement marker as defined in claim 6 wherein said biasing means comprises a lower compression member and an upper compression member, said upper compression member received within and filling substantially all the space within said piston and said lower compression member is positioned within said base beneath said piston, said compression members minimizing void space in said piston and said base to inhibit accumulation of moisture therein.

8. The pavement marker as defined in claim 7 wherein said compression members include axial throughbores for receiving said central spool, said compression members and said spool ensuring return of said piston to its normal position.

9. The pavement marker as defined in claim 8 wherein said base includes a seat receiving a lower end of said spool to maintain alignment of said biasing means within said housing.

10. The pavement marker as defined in claim 8 wherein said compression members are made of a compressible closed-cell foam material impervious to moisture.

11. The pavement marker as defined in claim 8 wherein said central spool is made of a resilient rubber material.

12. A reflective pavement marker comprising:

a housing adapted to be fixedly mounted within an opening formed within a pavement such that an upper end of said housing is positioned at or below the pavement surf ace, said housing including a base and a retainer removably secured to said base, said retainer including an upper aperture having a non-circular configuration;

a piston reciprocally movable within said housing, said piston including an upper end normally protruding above said housing and the pavement surface and a non-circular peripheral configuration whereby said piston matingly cooperates with said upper aperture of said retainer to restrict rotation of said piston within said housing, said piston being depressible downwardly in said housing to move said upper end into said housing;

a reflector assembly mounted to said upper end of said piston such that said reflector assembly is normally positioned above the pavement surface; and resiliently compressible means biasing said piston upwardly to raise said upper end of said piston above said housing and the pavement surf ace, said means including at least one compression member and at least one rebound member such that said piston returns to its normal position following depression of said piston into said housing as a result of surface traffic.

13. The pavement marker as defined in claim 12 wherein said reflector assembly is removably mounted to said upper end of said piston to facilitate repair and replacement of said reflector assembly.

14. The pavement marker as defined in claim 12 wherein said aperture of said retainer and said outer periphery of said piston have mating continuous lobe configurations to prevent rotation of said piston within said housing while distributing rotational torque over the entire periphery of said piston and said retainer aperture.

15. The pavement marker as defined in claim 12 wherein said biasing means comprises a lower compression member, an upper compression member and a central rebound spool extending through said upper and lower compression members, said upper compression member received within and filling substantially all the space within said piston and said lower compression member is positioned within said base beneath said piston, said compression members minimizing void space in said piston and said base to inhibit accumulation of moisture.

16. The pavement marker as defined in claim 15 wherein said compression members include axial throughbores for receiving said central rebound spool, said spool including a lower end received within a centering seat formed in said base and an upper end engaging said piston thereby ensuring return of said piston to its normal position.

17. A reflective pavement marker comprising:

a housing adapted to be fixedly mounted within an opening formed within a pavement such that an upper end of said housing is positioned at or below the pavement surface, said housing including a base and a retainer secured to said base, said retainer including an upper aperture having a lobed configuration;

a piston reciprocally movable within said housing, said piston including an upper end normally protruding above said housing and the pavement surface and a lobed peripheral configuration whereby said piston matingly cooperates with said upper aperture of said retainer preventing rotation of said piston within said housing, said piston being depressible downwardly in said housing to move said upper end of said piston into said housing;

a reflector assembly mounted to said upper end of said piston such that said reflector assembly is normally positioned above the pavement surface; and resiliently compressible means biasing said piston upwardly to raise said upper end of said piston and said ref lector assembly above said housing and the pavement surf ace, said biasing means filling substantially all the space within the piston and housing to prevent accumulation of moisture and including at least one compression member and a central rebound spool such that said means is resiliently compressible upon depression of said piston in said housing and returns said piston to its normal position.

18. The pavement marker as defined in claim 17 wherein said reflector assembly is removably mounted to said upper end of said piston to facilitate repair and replacement of said reflector assembly.

19. The pavement marker as defined in claim 17 wherein said biasing means comprises a lower compression member and upper compression member, said upper compression member received within and filling substantially all the space within said piston and said lower compression member is positioned within said base beneath said piston, said compression members minimizing void space in said piston and said base to inhibit accumulation of moisture within said marker.

20. The pavement marker as defined in claim 19 wherein said compression members include axial throughbore for receiving said central spool, said compression members facilitating depression of said piston into said housing and said spool ensuring return of said piston to its normal position.

21. The pavement marker as defined in claim 17 wherein said base member includes a plurality of ribs formed on the outer surface thereof for maintaining said marker within the pavement.

* * * * *